US006513742B2

(12) United States Patent
Watson

(10) Patent No.: US 6,513,742 B2
(45) Date of Patent: Feb. 4, 2003

(54) THREAD CASSETTE

(76) Inventor: Charles Watson, 315 Waugh Way, Bastrop, TX (US) 78602

( * ) Notice: Subject to any disclaimer, the term of this patent is extended or adjusted under 35 U.S.C. 154(b) by 3 days.

(21) Appl. No.: 09/824,183

(22) Filed: Apr. 3, 2001

(65) Prior Publication Data

US 2002/0139885 A1 Oct. 3, 2002

(51) Int. Cl.[7] ..... B65H 55/00; B65H 49/38; B65H 75/18

(52) U.S. Cl. ..... 242/171; 242/137.1; 242/594.5; 242/596.8; 112/302

(58) Field of Search ..... 242/171, 170, 242/594.5, 596.8, 128, 137.1, 588.5, 588.6; 112/169, 259, 302, 258

(56) References Cited

U.S. PATENT DOCUMENTS

| | | | | | |
|---|---|---|---|---|---|
| 349,440 | A | * | 9/1886 | Looker | 242/137.1 |
| 962,285 | A | | 6/1910 | Witt | |
| 2,588,540 | A | * | 3/1952 | Koistinen | 242/137.1 X |
| 3,749,039 | A | * | 7/1973 | Fritts | 112/302 |
| 4,019,636 | A | * | 4/1977 | Wise | 242/171 X |
| 4,026,063 | A | * | 5/1977 | Allen et al. | 242/137.1 X |
| 4,039,092 | A | | 8/1977 | Schär | |
| 4,081,154 | A | * | 3/1978 | Miszkwitz, Jr. | 242/137.1 X |
| 4,183,313 | A | * | 1/1980 | Odermann et al. | 112/302 |
| 4,449,837 | A | | 5/1984 | Craft | |
| 4,475,699 | A | * | 10/1984 | Calvin | 242/137.1 |
| 4,546,879 | A | | 10/1985 | Viscasillas | |
| 4,669,681 | A | | 6/1987 | Hansen et al. | |
| 4,817,796 | A | * | 4/1989 | Camillo et al. | 242/171 X |
| 5,000,397 | A | | 3/1991 | Darrieux | |
| 5,222,683 | A | * | 6/1993 | Blackshire | 242/137.1 |
| 6,044,782 | A | | 4/2000 | Fressemann et al. | |

* cited by examiner

*Primary Examiner*—Kathy Matecki
*Assistant Examiner*—Minh-Chau Pham

(57) ABSTRACT

A thread cassette in the form of a cassette-like plastic box adapted for holding two bobbins of thread. Once assembled with the bobbins disposed therein, the cassette cannot be reopened. The cassette casing enables thread therein to be easily and readily dispensed on demand. The plastic box features an integral cylindrical element which fits a standard sewing machine spool spindle. A single-bobbin casing is another embodiment of the invention. The two-bobbin embodiment may be used for supplying thread to a two-needle sewing machine.

7 Claims, 6 Drawing Sheets

THREAD CASSETTE

BACKGROUND OF THE INVENTION

1. Field of the Invention

The present invention relates to sewing thread dispensers, and, more particularly, a disposable cassette-like box for holding and dispensing thread from bobbins held therein.

2. Description of the Related Art

The dispensing of thread, such as for sewing, has been, generally cumbersome from commercial spools, as unneeded thread may easily be unrolled requiring re-rolling of the thread on the spool. This may easily occur if the spool is accidentally dropped. Also, the manipulation of the spool to start the thread unrolling process is subject to the same difficulties. A simple stackable, disposable dispenser for thread that may deliver one or more threads simultaneously for a single or multiple thread sewing machine which is mountable on a thread spool spindle is desirable.

U.S. Pat. No. 5,000,397, issued Mar. 19, 1991, to Darrieux, describes a cassette for the storage and dispensing of thread or ribbon at a preset tension. The cassette casing encloses a thread reel and thread dispensing members. The '397 device is specifically designed for use in producing filament wound articles and is complicated compared to the inventive device.

U.S. Pat. No. 4,669,681, issued Jun. 2, 1987, to Hansen et al. describes a cord-dispensing spool caddie having a number of cord spool mounting spindles arranged in a parallel relationship in a planar row within an elongated case. The '681 device is intended for use in dispensing insulated wire, and has no provision for attachment to a sewing machine.

U.S. Pat. No. 4,449,837, issued May 22, 1984, to Craft, describes a ribbon cartridge having a supply spool and a take-up spool. The '837 device is a cartridge or cassette for typewriter ribbon and is not suitable for dispensing thread.

U.S. Pat. No. 4,039,092, issued Aug. 2, 1977, to Schär, describes a bobbin package storage box. The '092 device is designed for large industrial machines and does not provide a simple, disposable device for sewing machine use according to the present invention.

U.S. Pat. No. 6,044,782, issued Apr. 4, 2000, to Fressemann et al., describes a bobbin holder for a sewing machine. The '782 cassette is specifically designed for use with a serger, requiring several threads, rather than the typical one or two thread sewing machine. Also, the '782 cassette removes thread from bobbins at a severe angle, which could cause dispensing problems when compared to the present inventive cassette.

U.S. Pat. No. 962,285, issued Jun. 21, 1910, to Witt, describes a thread cabinet for holding spools of thread, and having a means to cut the thread. The '285 device is not a disposable device which is attachable to a sewing machine as in the present invention.

U.S. Pat. No. 4,546,879, issued Oct. 15, 1985, to Viscasillas, describes a sealed dispenser for dispensing tape. The '879 device is specifically designed for dispensing hook and loop tapes together, and has no provision for attachment to a sewing machine.

None of the above inventions and patents, taken either singularly or in combination, is seen to describe the instant invention as claimed. Thus, a thread cassette solving the aforementioned problems is desired.

SUMMARY OF THE INVENTION

The present invention is a cassette-like plastic box adapted for holding two bobbins of thread. Once assembled with the bobbins disposed therein, the cassette cannot be reopened. The cassette casing enables thread disposed therein to be easily and readily dispensed on demand. A single-bobbin casing is another embodiment of the invention. The cassette feature a cylinder for mounting on the spindle of a sewing machine. The two bobbin embodiment is useful in two-thread sewing machines.

Accordingly, it is a principal object of the invention to provide a thread dispenser which is constructed of transparent material which provides for the convenient dispensing of the desired color of thread by the user.

It is another object of the invention to provide a thread dispenser which is in the form of a cassette and provides for dispensing of one or more different threads.

It is a further object of the invention to provide a thread dispenser which holds bobbins of thread for dispensing which are permanently held for rotation by axles formed upon the assembly of the cassette.

Still another object of the invention is to provide a thread cassette dispenser from which two threads are respectively removable for easily supporting sewing machines with twin needles.

Yet another object of the invention to provide thread dispensing cassettes which are flat and of a uniform size so as to be easily stackable.

Still another object of the invention is to provide a thread dispensing cassette which is totally interchangeable with a contemporary spool of thread.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
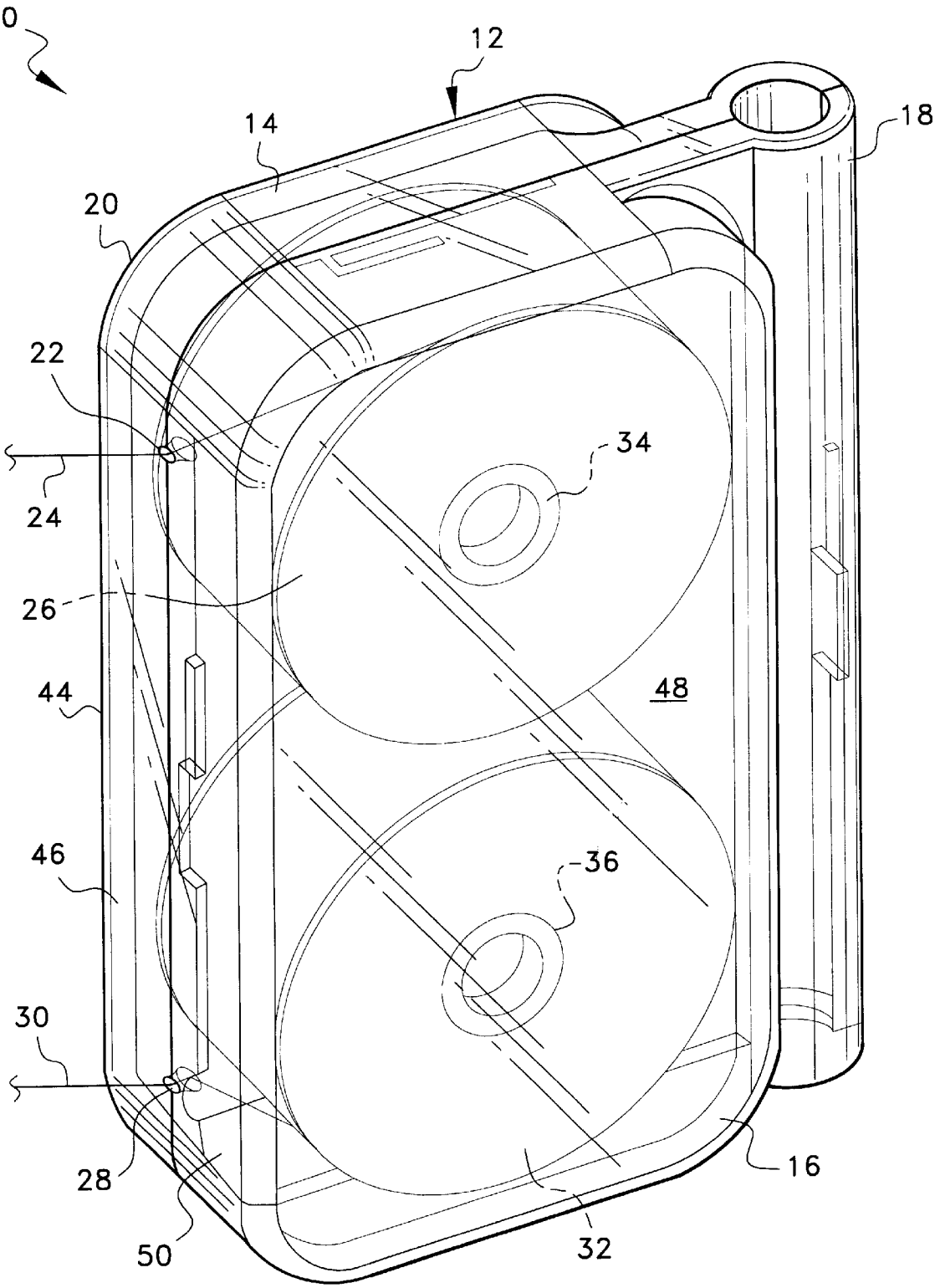
FIG. 1 is a perspective view of a thread dispensing cassette according to the present invention.
Figure 2:
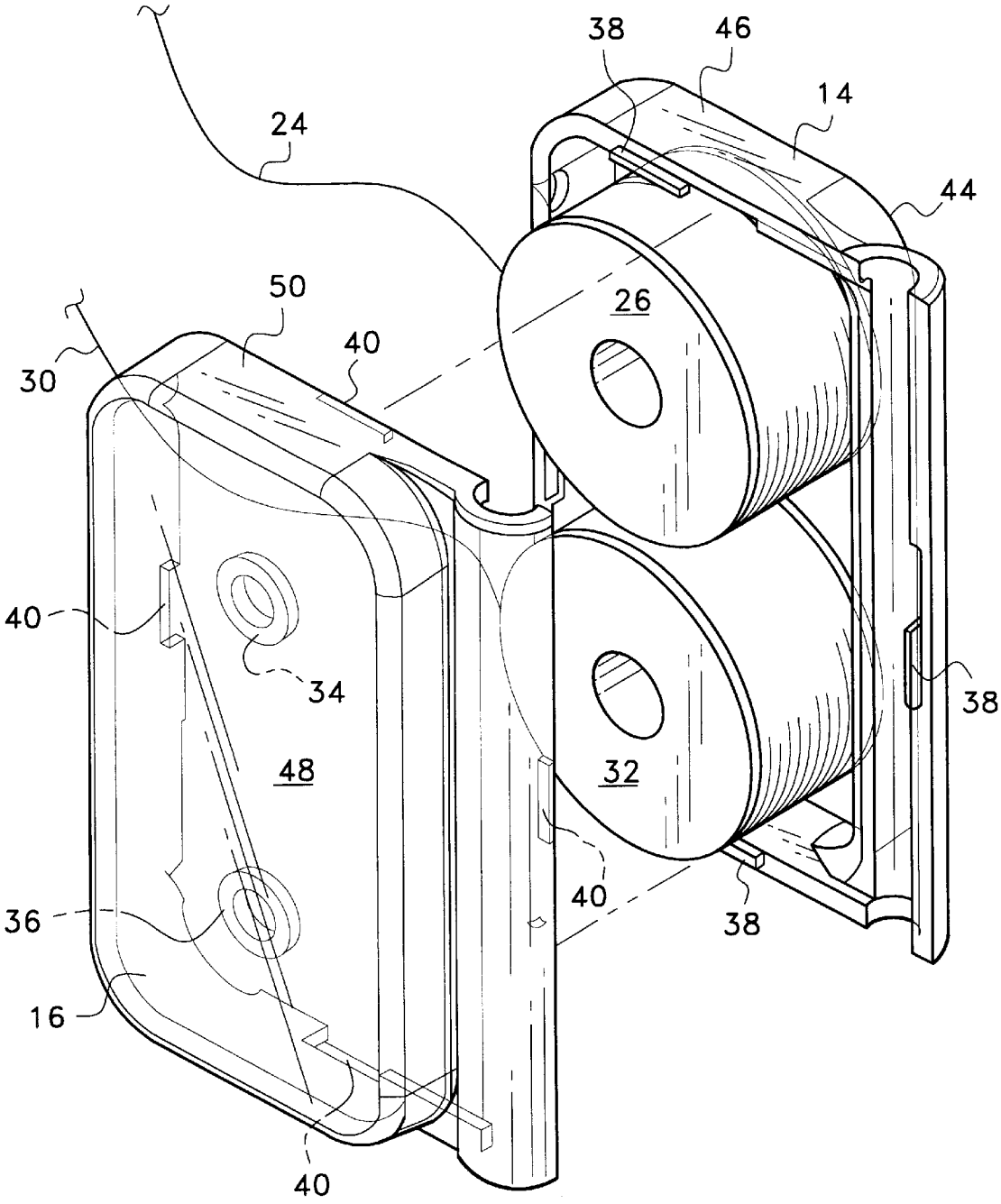
FIG. 2 is an exploded view of the thread dispensing cassette of FIG. 1.
Figure 3:
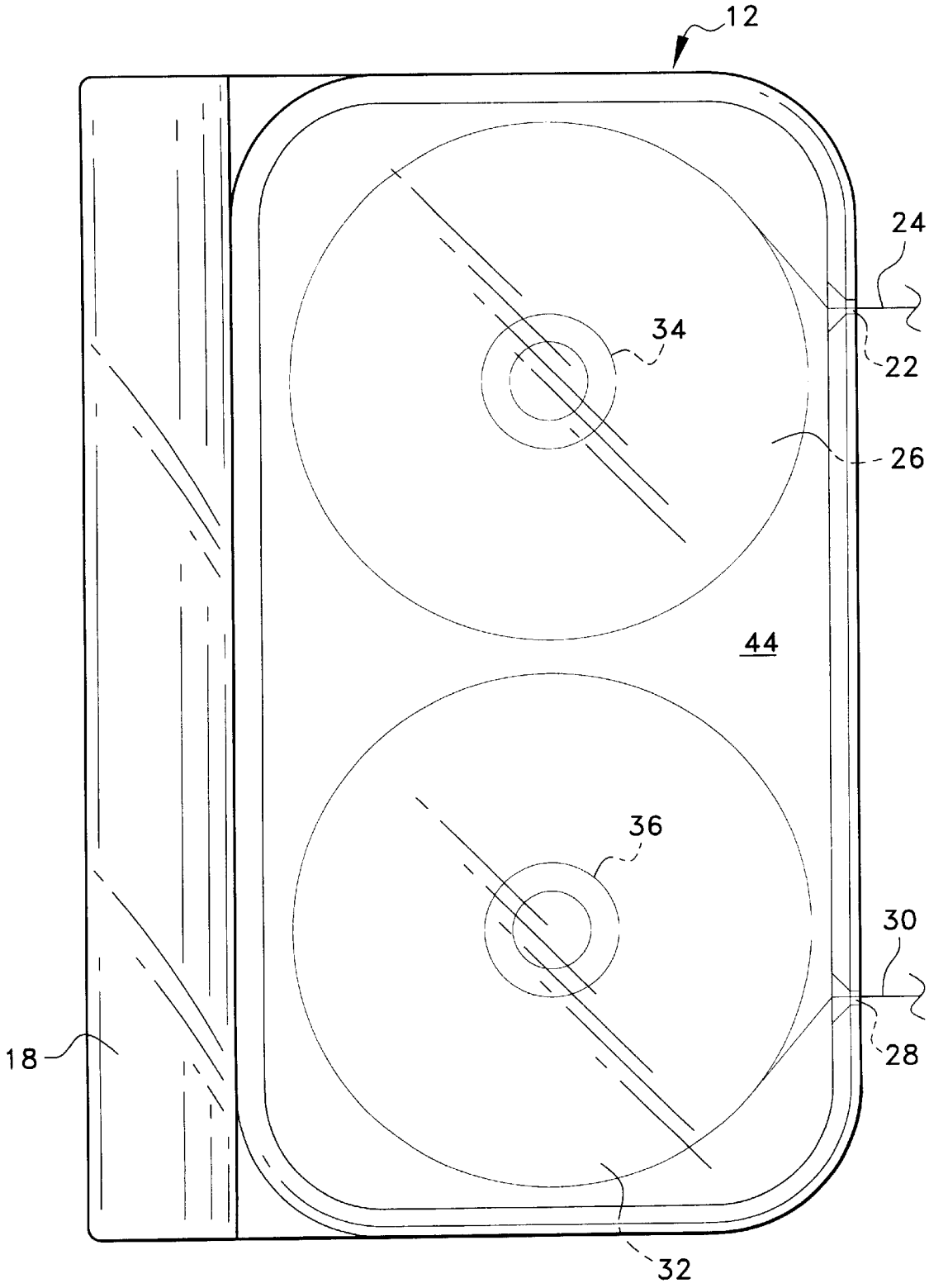
FIG. 3 is a side view of the thread dispensing cassette of FIG. 1.
Figure 4:
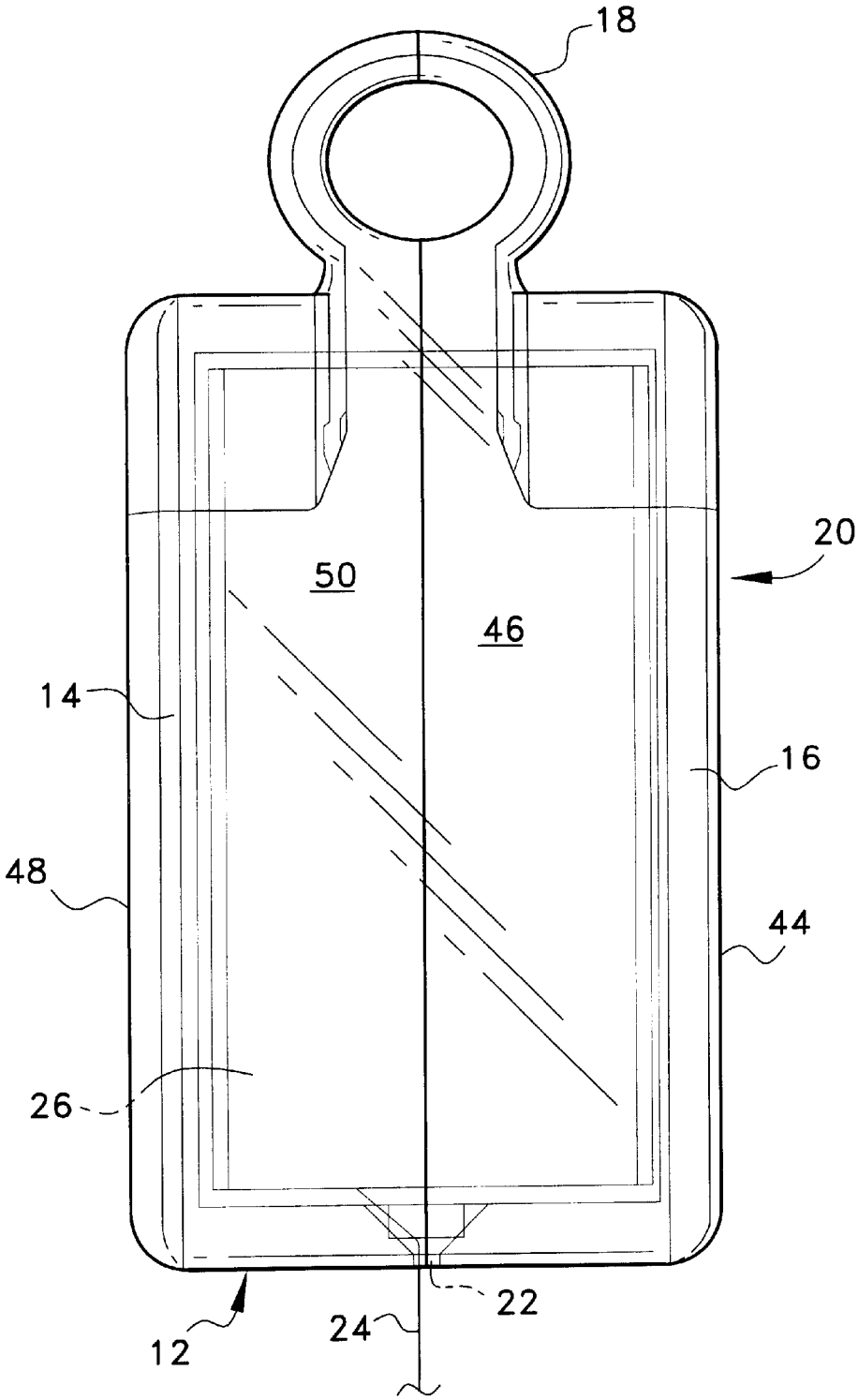
FIG. 4 is a top view in elevation of the thread dispensing cassette of FIG. 3.
Figure 5:
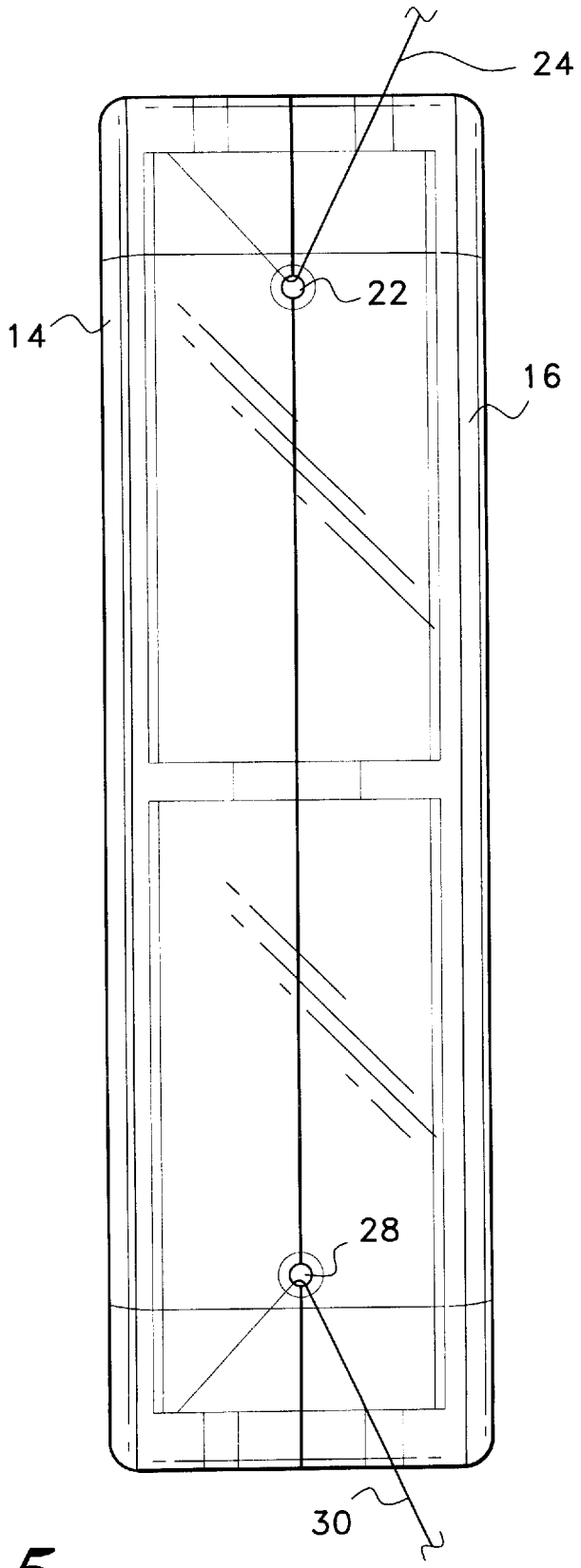
FIG. 5 is an end view in elevation of the thread dispensing cassette of FIG. 3.

The present invention is a cassette-like plastic box adapted for holding two bobbins of thread. Once assembled with the bobbins disposed therein, the cassette cannot be reopened. The cassette casing enables thread disposed therein to be easily and readily dispensed on demand. The plastic box features an integral cylindrical element which fits a standard sewing machine thread spool spindle. A single-bobbin casing is another embodiment of the invention.

Referring to FIGS. 1–5, there is shown a perspective view, an exploded view, a side view, a top view in elevation, and an end view in elevation of the thread dispensing cassette of the present invention, respectively. Thread cassette 10 comprises thread cassette shell 12, constructed of first half shell 14 and second half shell 16. Thread cassette 12 forms a sewing machine spool spindle engaging portion 18 and a bobbin cassette portion 20. Cassette portion 20 features first thread outlet 22 for first thread 24 dispensed from first bobbin 26. Cassette portion 20 also features second thread outlet 28 for second thread 30 dispensed from second bobbin 32. First bobbin 26 is rotatably mounted on first bobbin axle 34, and second bobbin 32 is rotatably mounted on second bobbin axle 36.

Interlocks 38 are located on first half-shell 14 which cooperate with interlock receivers 40 located on second half-shell 16. First half-shell 14 comprises first half shell wall 44, and first half-shell perimeter wall 46. Second half-shell 16 comprises second half-shell wall 48 and second half-shell perimeter wall 50. First bobbin axle 34 and second bobbin axle 36 are integral with second half-shell wall 48, each bobbin axle projecting inward therefrom.

First thread outlet 22 and second thread outlet 28 are preferably chamfered on their inner portions to assist in dispensing their respective threads over a range of angles as they unwind from their respective bobbins, and are preferably located in, the cassette shell at points opposite spindle engaging portion 18 at the interface of first and second half shells 14 and 16.

Thread cassette 10 is assembled by placing bobbins 26 and 32 on their respective bobbin axles 34 and 36 which are integral with second half shell wall 48. Threads 24 and 30 are unwound from their respective bobbins 26 and 32 and placed in their respective thread outlets 22 and 28 partially formed in second half shell perimeter wall 50 at the half-shells interface. First half shell 14 is then placed over first and second bobbins 26 and 32 and interlocks 38 of first half shell 14 are urged into interlock receivers 40 on second half shell 16, thus making a permanent mechanical union therebetween and forming first and second thread outlets 22 and 28 within the combined perimeter walls 46 and 50 which form cassette portion 20 and spindle engaging portion 18 of thread cassette shell 12.

In use, the inventive thread cassette 10 may be used as a source of thread, individually, or placed on a two-needle sewing machine by means of spindle engaging portion 18. The thread, cassette 10 is discarded once the thread is consumed.

Figure 6:
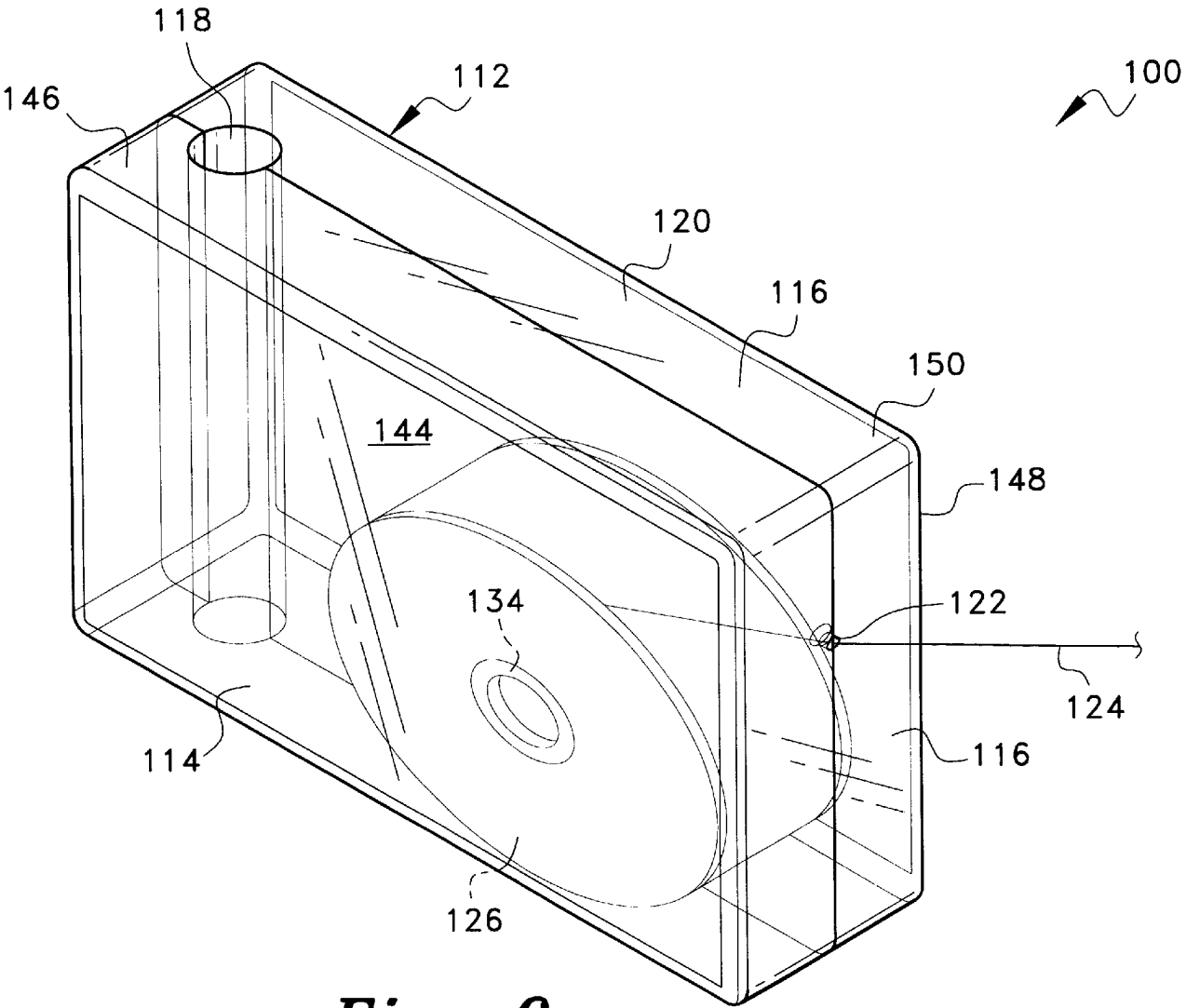
FIG. 6 is a perspective view of another embodiment of the present invention.

Referring to FIG. 6, there is shown a single bobbin embodiment of the present inventive thread cassette 100 comprising thread cassette shell 112. Thread cassette shell 112 comprises first half-shell 114 and second half shell 116. Thread cassette shell 112 forms a combined sewing machine spindle engaging portion 118 and cassette portion 120. Cassette portion 120 features thread outlet 122 for thread 124 dispensed from bobbin 126. Bobbin 126 is rotatably mounted on bobbin axle 134.

Interlocks (not shown) are located on first half-shell 114 which cooperate with interlock receivers(not shown) located on second half-shell 116. First half-shell 114 comprises first half shell wall 144, and first half-shell perimeter wall 146. Second half-shell 116 comprises second half-shell wall 148 and second half-shell perimeter wall 150. Bobbin axle 134 is integral with first half-shell wall 144, bobbin axle 134 being integral with and projecting inward therefrom.

Thread outlet 122 is preferably chamfered on its inner portion to assist in dispensing thread 124 over a range of angles as it unwinds from bobbin 126, and is preferably located in cassette portion 120 at a point opposite spindle engaging portion 118 at the interface of first and second half shells 114 and 116.

Thread cassette shell 112 is assembled by placing bobbin 126 on bobbin axle 134 which are integral with first half-shell wall 144. Thread 124 is unwound from bobbin 126 and placed in thread outlet 122 partially formed in second half-shell perimeter wall 150 at the half-shells interface. Second half-shell 116 is then placed over bobbin 126 and the interlocks of first half-shell 114 are urged into the interlock receivers on second half-shell 116 (see the interlocks of the first embodiment 10, above), thus making a permanent mechanical union therebetween and forming thread outlet, 122 within the combined perimeter walls 146 and 150, which form cassette portion 120 and spindle engaging portion 118 of thread cassette shell 112.

In use, the inventive thread cassette 100 may be used as a source of thread, individually, or placed on a single needle sewing machine by means of spindle engaging portion 118. The thread cassette 100 is discarded once the thread is consumed.

The preferred material of the present invention is clear plastic such as that used in forming tape cassettes such as polystyrene, so the user can easily determine the amount of thread remaining in the cassette. The cassettes are preferably configured so as to be easily stackable so as to allow the user to keep a variety of thread color combinations within a small, convenient workplace.

It is to be understood that the present invention is not limited to the embodiments described above, but encompasses any and all embodiments within the scope of the following claims.

I claim:

1. A thread cassette comprising:

a) a generally rectangular cassette shell having opposing first and second walls, and perimeter walls with opposing portions, said first and second walls connected by said perimeter walls, said cassette shell including a cassette portion and an integrally connected spindle engaging portion, said spindle engaging portion being located at an end section of said rectangular cassette shell and defines a cylinder for mounting on a spindle of a sewing machine;

b) at least one thread bobbin located for rotation within said cassette shell; and c) a thread carried on said at least one bobbin;

d) said cassette shell having at least one thread outlet located in said perimeter walls at a point remote from said spindle engaging portion such that thread may be removed from the cassette by pulling said thread from said shell while rotating said thread bobbin.

2. The thread cassette of claim 1 wherein said thread outlet has an outer portion and an inner portion, said inner portion being chamfered to receive thread from said bobbin over a range of angles.

3. The thread cassette of claim 1 further comprising an axle for rotation of at least said one bobbin.

4. The thread cassette of claim 3 wherein said axle is integral with one of said first and said second walls.

5. A thread cassette comprising:

a) a generally rectangular cassette shell including a first half-shell section and a second half-shell section, said first half-shell section having a first wall connected by a first perimeter wall, said second half-shell section having a second wall connected by a second perimeter wall, said second wall including at least one axle integral therewith, said first half-shell section and said second half-shell section having a common separation along said first perimeter wall and said second perimeter wall, wherein said first half-shell section further comprises a plurality of interlocks, and said second half-shell section further comprises a plurality of interlock receivers corresponding to said interlocks, whereby said first and second half-shell sections are permanently locked together;

b) at least one thread bobbin disposed on said at least one axle for rotation of said bobbin within said cassette shell; and c) a thread carried on said at least one bobbin;

d) said cassette shell having at least one thread outlet defined at the common separation along said first perimeter wall and said second perimeter wall such that thread may be removed from the cassette by pulling said thread from said shell while rotating said thread bobbin.

6. The thread cassette of claim 5, wherein said at least one thread bobbin includes two bobbins, each carrying a separate thread, and said at least one thread outlet includes two thread outlets for separately dispensing each said thread.

7. The thread cassette of claim 6, wherein said cassette shell further comprises a cassette portion and a spindle engaging portion, each of said two bobbins being housed in said cassette portion, said spindle engaging portion defining a cylinder for receiving a sewing machine spool spindle.

* * * * *